US005249952A

United States Patent [19]

West et al.

[11] Patent Number: 5,249,952

[45] Date of Patent: Oct. 5, 1993

[54] EXHAUST FUME ENERGY SOURCE AND WASTE COMBUSTION APPARATUS

[75] Inventors: Bill West, Laguna Niguel; Thomas Trulis, San Juan Capistrano, both of Calif.

[73] Assignee: Cosmos Ventures, Inc., San Juan Capistrano, Calif.

[21] Appl. No.: 874,245

[22] Filed: Apr. 24, 1992

[51] Int. Cl.[5] ..... F23C 6/04; F23C 3/00

[52] U.S. Cl. ..... 431/5; 431/1; 431/158; 431/350; 431/351; 60/39.77; 110/346; 110/235

[58] Field of Search ..... 431/5, 158, 10, 1, 351, 431/352, 350; 60/282, 733, 746, 303, 312, 733, 39.79, 39.80, 39.77; 422/168, 170, 172, 176, 194, 195, 220, 182, 183, 169; 110/235, 346, 262, 265

[56] References Cited

U.S. PATENT DOCUMENTS

| | | | |
|---|---|---|---|
| 3,195,608 | 7/1965 | Voorheis et al. | 431/5 |
| 3,267,986 | 8/1966 | Olsson | 431/1 |
| 3,320,999 | 5/1967 | Stalego | 431/158 |
| 3,407,594 | 10/1968 | McComb | 60/39.8 |
| 4,382,771 | 5/1983 | Carr | 431/158 |
| 4,924,407 | 12/1975 | Hosho et al. | 60/303 X |
| 5,052,919 | 10/1991 | Becker | 431/10 |
| 5,125,828 | 6/1992 | Browning | 431/158 |

FOREIGN PATENT DOCUMENTS

| | | | |
|---|---|---|---|
| 750516 | 3/1944 | Fed. Rep. of Germany | 60/39.77 |
| 1151764 | 4/1985 | U.S.S.R. | 431/1 |

*Primary Examiner*—Carl D. Price

*Attorney, Agent, or Firm*—Beehler & Pavitt

[57] ABSTRACT

A three-chambered combustion burner is provided with a seed fuel under pressure to burn simultaneously injected waste products such as incompletely combusted exhaust fumes or air entrained combustible solid waste. An explosive mixture is provided in a first chamber and ignited. The heated and pressurized gas products are ejected into a second smaller combustion chamber into which air is injected. The hot and incompletely combusted products in the second chamber explosively reignite and are ejected into a yet smaller third combustion chamber. Air is again injected into the third combustion chamber wherein the products again explosively reignite to be ejected through a jet nozzle. The heat energy output of the burner or its propulsive momentum thrust may be utilized as appropriate in other applications. The toxicity of the gaseous or solid waste products burnt in the chambers is reduced and oxidized by the injection of air and hydrolization of water also injected with the waste products.

5 Claims, 2 Drawing Sheets

EXHAUST FUME ENERGY SOURCE AND WASTE COMBUSTION APPARATUS

BACKGROUND OF THE INVENTION

1. Field of the Invention

The invention relates to the field of combustion chambers and in particular to an apparatus for providing continuous combustion of a variety of fuels, including waste fuels, to provide a jet thrust and heat energy output.

2. Description of the Prior Art

The processing of combustible waste, such as green waste, solid waste, organic waste and the like through incineration is well known. Similarly, the treatment of waste exhaust fumes from engine and other combustion sources through after burners, catalytic converters, or two-pass burners is similarly widely used throughout a broad spectrum of applications. However, those concerned with solid waste management have generally not been concerned with the treatment of waste exhaust gases as the primary waste product which must be processed. Similarly, those concerned with treatment of engine exhaust waste are rarely confronted with or address the problems concerned with processing solid waste. Nevertheless, the technology of solid waste treatment and gaseous waste treatment share a single problem in common, namely the reduction of a complex and sometimes toxic waste product into simpler non-toxic by-products.

What is needed is a method and apparatus which draws from technologies concerned with both gaseous and solid waste treatments to provide a means for treating both solid and gaseous wastes.

Further, what is needed is an apparatus and methodology wherein solid and gaseous waste may be processed while at the same time providing useful energy.

Still further, the method and apparatus for dual treatment of solid and gaseous waste and generation of energy should be small, light, simply operated and of a nature which is universally adaptable to a wide range of end uses.

BRIEF SUMMARY OF THE INVENTION

The invention is an apparatus for combusting a variety of combustible products comprising an injection mechanism for injection the combustible products to form explosive mixtures. The combustible products are injected into a combustion assembly for multiply combusting the injected combustible products in multiple explosive combustions. An ejection mechanism ejects the multiply combusted products. As a result, the variety of fuels may be combusted within the apparatus.

In one embodiment the combustible products comprise waste products. The waste products are, for example, incompletely combusted exhaust gases from other sources, such as internal combustion engines. In another embodiment the waste products may also comprise solid combustible waste.

The waste products are combined with controlled amounts of water. The water is hydrolyzed within the combustion assembly for reducing and oxidizing the waste products.

The combustion assembly comprises a plurality of serially communicated combustion chambers. The plurality of serially communicated combustion chambers comprise a sequence of combustion chambers of decreasing volume. The volume decreases from a first input chambers to a final output chamber. The output chamber is the smallest chamber of the plurality of chambers. In the preferred embodiment there are three serially communicated chambers.

The input chamber is provided with injected combustible fuel by the injection mechanism. The remaining ones of the plurality of serially communicated chambers receive in sequence combustion products from preceding ones of the plurality of chambers. Each of the chambers further comprise a mechanism for injecting an oxidizing agent, such as air, into the chamber.

The apparatus further comprises an ignition mechanism communicating with the input chamber for initiating combustion in the apparatus. The ejection mechanism comprises a nozzle for providing a jet thrust.

The apparatus further comprises a controller for controlling the injection mechanism, combustion assembly and injection mechanism according to the combustion products supplied thereto and to establish a continuous self-sustaining combustion within the apparatus.

The apparatus still further comprises a secondary process or apparatus for utilizing energy produced by the apparatus and the ejected exhaust gases.

The invention is also characterized as a method for selectively producing energy, controlling pollution and processing waste products comprising the steps of providing the waste products to multiple chambers in a combustion pig. An oxidizing agent is provided to the multiple chambers within the pig. An explosive combustion is initiated within a first chamber within the pig. The explosive combustion is propagated from the first chamber to the other chambers within the pig. Hot, combusted exhaust gases which are multiply combusted within the pig, are ejected. As a result, pollution of the waste products is controlled, energy is produced, and the waste products are processed.

In the step of providing waste products, the waste products comprise incompletely combusted waste gases from other combustion sources, such as combustible solid waste.

In the preferred embodiment the step of propagating explosive combustion through the plurality of chambers comprises the steps of propagating an explosive combustion through three serially communicated combustion chambers.

The method further comprises the step of forming a jet thrust with the ejected hot combustion exhaust gases.

The invention and its various embodiments may be better understood by now turning to the following drawings, wherein like elements are referenced by like numerals.

The invention and its various embodiments can now be understood in light to the above drawings by means of the following detailed description.

DETAILED DESCRIPTION OF THE PREFERRED EMBODIMENTS

A three-chambered combustion burner is provided with a seed fuel under pressure to burn simultaneously injected waste products such as incompletely combusted exhaust fumes or air entrained combustible solid waste. An explosive mixture is provided in a first chamber and ignited. The heated and pressurized gas products are ejected into a second smaller combustion chamber into which air is injected. The hot and incompletely combusted products in the second chamber explosively reignite and are ejected into a yet smaller third combustion chamber. Air is again injected into the third combustion chamber wherein the products again explosively reignite to be ejected through a jet nozzle. The heat energy output of the burner or its propulsive momentum thrust may be utilized as appropriate in other applications. The toxicity of the gaseous or solid waste products burnt in the chambers is reduced and oxidized by the injection of air and hydrolization of water also injected with the waste products.

Figure 1:
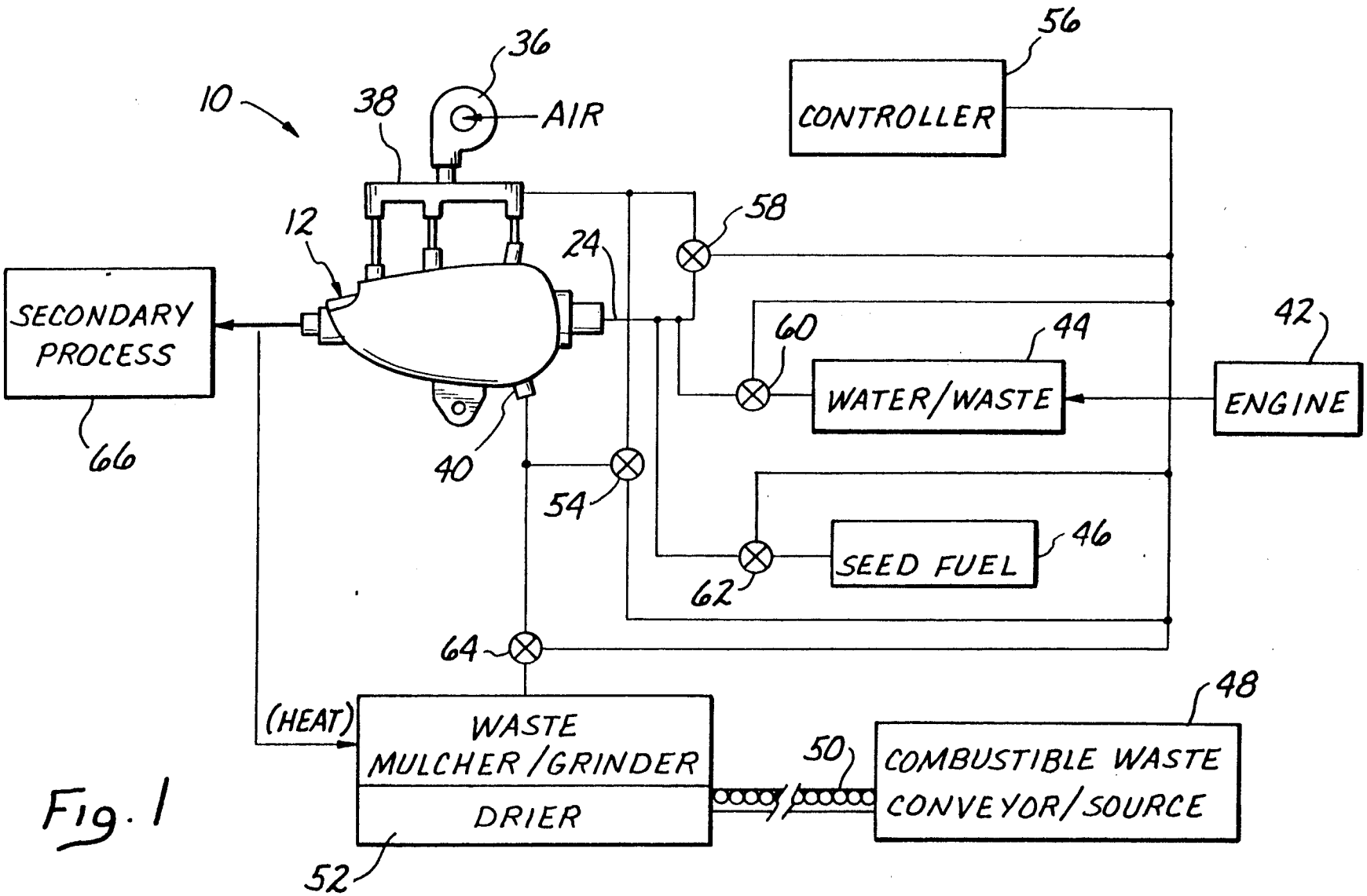
FIG. 1 is diagrammatic system diagram of one embodiment of the invention showing how the burner or pig is utilized for energy generation and waste treatment.

FIG. 1 illustrates a system, generally denoted by reference numeral 10, wherein a combustion assembly 12, or as may be hereinafter referred to as a pig 12, is used to generate energy and process solid, liquid and/or gaseous wastes.

Figure 2:
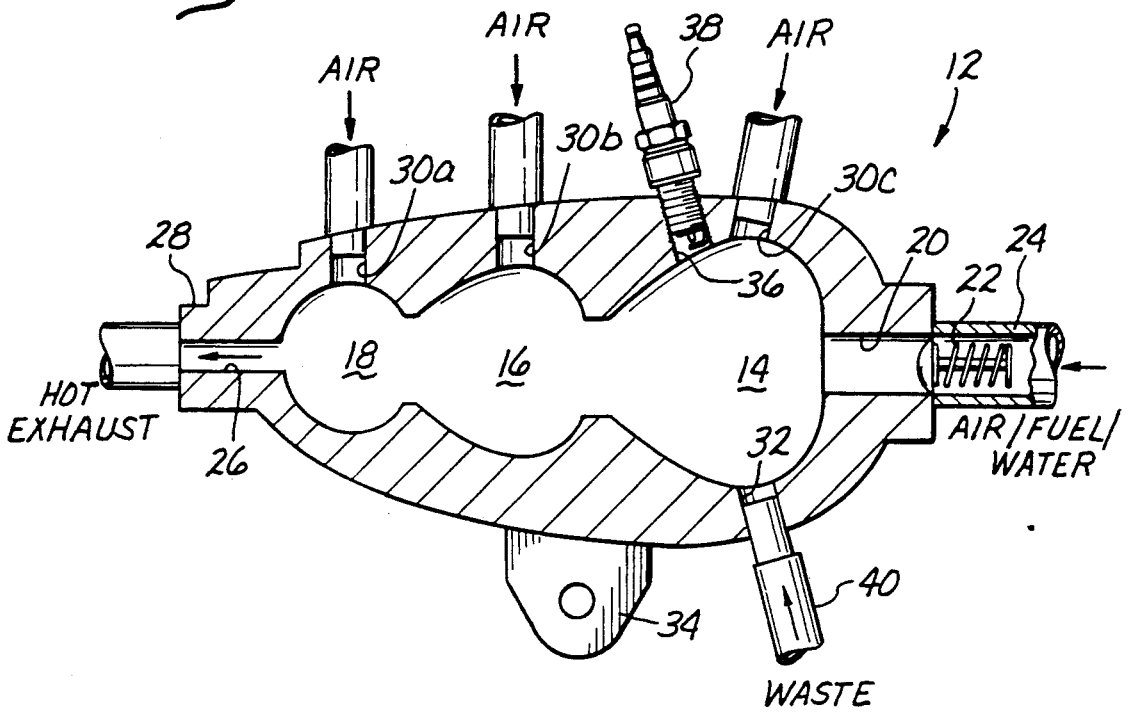
FIG. 2 is a cross sectional view of the pig diagrammatically depicted in FIG. 1.
Figure 3:
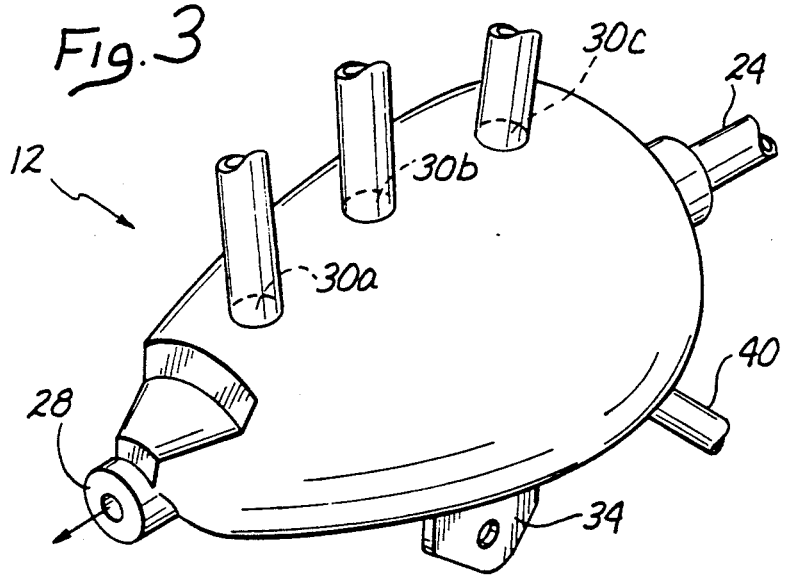
FIG. 3 is a perspective of the pig shown in cross section in FIG. 2.

Before considering system 10 in the embodiment of FIG. 1, turn first to the detailed construction of pig 12 as shown in cross section view in FIG. 2 and in perspective view in FIG. 3. Pig 12 in the illustrated embodiment is fabricated from cast iron and is comprised of three combustion chambers 14–18. The first of these combustion chambers, combustion chamber 14, is shown within pig 12 at the right-hand end in the depiction of FIG. 2. Combustion chamber 14 is the largest of the three chambers and is provided with an input port 20. Input port 20 is fitted with a spring-loaded one-way valve 22 so that fluid flowing within line 24 may be injected into chamber 14, but when the pressure of combusting gas within chamber 14 increases to a level higher than the pressure within inlet port 20, valve 22 closes thereby prevent ejection of any of the combustion products into line 24. The term "fluid" is used in the application to generally mean any liquid or gaseous substance, although in the preferred embodiment, an air, fuel and/or water mixture either in droplet or vaporized form is provided under pressure within line 24 to inlet port 20 of chamber 14.

Chamber 14 communicates at its left end as shown in FIG. 2 with a second and somewhat smaller combustion chamber 16. Combustion chamber 16 similarly communicates at its left end with a yet smaller combustion chamber 18. Combustion chamber 18 is then coupled through an exhaust port 26 to exhaust nozzle 28 of pig 12. The series of three chambers thus serve a nozzle effect, increasing the velocity and temperature of the escaping gas products as the space provided by the chambers to the combustion gases becomes smaller and smaller. Although three chambers have been described in the preferred embodiment, it must be understood that any number of two or more chambers may be used.

Each combustion chamber 14–18 is provided with an air injection port 30. Air, oxygen or another oxidizing agent is supplied or injected through ports 30 into the respective combustion chambers 14–18.

Each of the combustion chambers 14–18 may also be provided with a second supply port 32 in which combustible products, such as combustible waste products, are injected. In the depiction of FIG. 2, only the first or initial 14 is provided with a waste injection port 32. However, it must be expressly understood that each of the additional chambers 16 and 18 may also be similarly provided if desired.

Pig 12 is characterized by thick cast iron walls which provide a strong, integral containment for chambers 14, 16 and 18 so that substantial pressures or explosions within chambers 14, 16 and 18 are safely contained. One or more mounting brackets 34 may also be formed as part of the body of pig 12 to provide a convenient means for mechanically mounting pig 12 in a chassis or larger assembly.

Combustion chamber 14 is also provided with an ignition port 36 into which has been threaded an igniter 38, which in the illustrated embodiment is a conventional automotive spark plug. Initially, the combustion products are forced into chamber 14, as described below, and the combustion ignited by igniter 38. In the illustrated embodiment, the combustion and air mixture is chosen such that the initially combustion is so rapid that it is explosive. The exhaust products are then explosively driven from chamber 14 into chamber 16. Additional air is then injected to injection port **30*b*. The temperature of the uncombusted explosion products from chamber 14 which are now turbulently mixed with new injected air through injection port 30*b*** reignites and explodes a second time.

In the mean time, combustion chamber 14 is provided with a new charge of combustion products which are again ignited and explosively propelled into combustion chamber 16. This tends to force the now twice exploded combustion products from chamber 16 into the third chamber 18. The third chamber 18 is again injected with a fresh air charge through injection port **30*a*. Since even the twice exploded products may not be entirely combusted, the injection of air into the hot products combined with pressure from the exploding gases delivered from chambers 14 and 16 cause the twice combusted products in chamber 18 to explode a third time. These three-times-exploded products, now under substantial pressure within chamber 18, are forcefully discharged through outlet port 96 and from the orifice of nozzle 28. The output of pig 12** is, therefore, a hot gas which is forcibly ejected at high velocity.

It is expressly to be understood that although chamber 14 is shown in the illustrated embodiment as the only chamber having an associated igniter 38, chambers 16 and 18 may, if desired, also be provided with igniters. However, in the preferred embodiment after a very short startup interval, the combustible products in chamber 14 become so hot and the pressure builds to a steady state maximum so that continual explosions are resonantly set up within chambers 14, 16 and 18 without the need for initializing ignition in these chambers. Therefore, once steady state operating conditions have been realized, pig 12 operates continuously at a resonant steady state frequency with repetitive self-sustaining explosions in chambers 14, 16 and 18. The frequency of these explosions depends not only on the geometry of pig 12, but also upon the air-to-fuel mixture as provided within inlet port 20 and waste injection port 32.

The basic structure of pig 12 now having been described and the nature of its operation illustrated, return now to the system of FIG. 1 which diagrammatically depicts one embodiment in which pig 12 may be utilized. Pressurized air or oxidizing agent is provided by means of a fan 36 to an air manifold 38. Pressurized air from manifold 38 is then provided to air injection ports 30*a–c* in pig 12 as well as to input line 24 and waste injection line 40. Input line 24 in turn is controllably provided with an exhaust fluid, i.e. a liquid or gas. The exhaust gas may originate with an engine 42 or any other conventional means of combustion products whose emissions are not totally combusted, which contain some percentage of incompletely combusted by-products and which would, therefore, be regarded as polluting.

This exhaust gas from source 42 may be directly injected into line 24 or may be conditioned by a mixer 44 prior to injection to line 24. For example, in one embodiment mixer 44 may mix a small amount of water or steam with the exhaust fume from source 42. The steam may be used in a steam injector or may simply be atomized into the exhaust fuel and carried with it into inlet port 20 of pig 12. Injection of a small water or steam into pig 12 serves in part to control the combustion process by slightly cooling the combustion gases within pig 12, but also is hydrolyzed at the temperatures and pressures within pig 12 to break down into oxygen and hydrogen. These elements are then available as reducing and oxidizing components for chemical combination with the exhaust fumes delivered with the steam to assist in reducing these pollutants to simpler, fully combusted and nontoxic forms. Similarly, the hydrolyzed water provides reducing and oxidizing agents which combine with introduced solid waste as described below.

In the illustrated embodiment, in order to initiate operation of pig 12 and to bring it to steady state operating pressures and temperatures, a small amount of seed fuel from source 46 may also be controllably injected into input line 24. After the combustion process within pig 12 becomes self-sustaining, injection of seed fuel from source 46 might be terminated if the combustible content of the exhaust fumes and solid wastes injected into pig 12 were enough to sustain burning. If not, it is expected that the seed fuel may be continually injected with the waste products. Any fuel may be used, such as gas, propane, diesel, kerosene, or the like and it may be chosen in a proportion and composition according to the energy content present in either the exhaust gas from source 42 or in the solid waste injected through port 32.

Solid waste such as commonly occurs in residential or commercial garbage is separated and the combustible portion thereof collected in a conveyor bin 48. The combustible solid waste is fed at a controlled rate by conveyor 50 from bin 48 into a waste processor 52. Waste processor 52 mulches, grinds and/or dries the waste delivered to it to a particle size wherein the waste can be air entrained or injected through waste port 32 in pig 12. Air from manifold 38 is controlled by valve 54 to waste processor 52 for this purpose. Valve 54 in turn is electronically controlled through a microprocessor controller 56.

Similarly, air injection in the main input line 24 is controlled by controller 56 by valve 58, exhaust gas and water injection through valve 60 and seed fuel through valve 62. Injection of air entrained solid waste is similarly controlled through valve 64 by controller 56. Controller 56 is preprogrammed to meter the various components described above provided to pig 12 in order to establish and maintain continuous combustion within pig 12 according to the teachings of the invention. Controller 56 may also be provided with sensor inputs which provide pressure and temperature feedbacks from pig 12 to adjust the injected constituents to maintain the combustion process.

The output of pig 12 may be utilized in a large variety of ways. Firstly, a portion of the hot exhaust gases may be redirected either back to input line 24 for multiple recombustion to assist in sustaining the combustion process, for further combusting any yet remaining uncombusted by-products or for drying in waste processor 52. Even when used as a drying agent to reduce the water content in the solid waste to a suitable value for use within pig 12, the recycled exhaust gases from pig 12 may still be reinjected with the solid waste back into pig 12 or may be simply exhausted to the environment when its heat content is spent. The drying and reduction of water content of solid waste products is, for example, important when the solid waste is green waste derived from lawn clippings, leaves, wood chips, cut shrubbery, branches and the like.

Alternatively and simultaneously, all or the remaining portion of the output of pig 12 may be directed to any type of secondary process, symbolically denoted by reference numeral 66, wherein heat is required to run or assist the process. Therefore, one of the advantages of pig is not only that it is a burner which can operate on a wide variety of fuels, including incompletely combusted exhaust fumes from other sources and solid waste, but it is also a source of high energy heat output and, therefore, may be used in applications where its primary utility is a heat source and it secondarily functions to burn or reduce other toxic waste fuels to completely combust exhaust products. On the other hand, utilization of pig 12 may be the reverse, namely its primary utilization may be the processing of solid and gas waste products and only secondarily used as a heat source for that or another unrelated purpose.

Still further, as mentioned above, the momentum or velocity of the exhaust gas that is being ejected from pig 12 can be substantial. Therefore, exhaust gases in addition to being a source of heat are also a source of momentum which can be used to drive a turbine or motor to provide mechanical shaft work.

Still further, because of the velocity of the output of pig 12, the pig can be adapted to be used as a source of jet thrust. For example, using pig 12 only as a jet thruster to burn conventional fuel. As one example, pig 12 can be included in an appropriate marine power plant to drive a small boat as a jet thruster.

Still further, pig 12 may be coupled to the exhaust of a diesel engine on a truck. Pig 12 draws diesel fuel as the seed fuel to process the exhaust from the truck. The heat produced by pig 12 or its mechanical thrust output is also used to power the refrigeration system on the truck in the case where it is a refrigerated trailer. The number of applications where the advantageous features of the pig can be employed is nearly limitless.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. The following claims are, therefore, to be read to include not only the combination of elements which are literally set forth, but all equivalent elements for performing substantially the same function in substantially the same way to obtain substantially the same result. The claims are thus to be understood to include what is specifically illustrated and described above, what is conceptionally equivalent, and also what essentially incorporates the germ of the invention.

We claim:

1. A method for selectively producing energy, controlling pollution and processing waste a variety of waste products comprising incompletely combusted waste gases from other combustion sources and combustible solid waste, said method comprising the steps of:

providing said variety of waste products to multiple chambers in a combustion device;

providing an oxidizing agent to each of said multiple chambers within said device;

initiating an explosive combustion within a first chamber within said device;

propagating said explosive combustion from said first chamber to said other chambers within said device to produce energy, said serially communicated combustion chambers being of decreasing size, beginning with a largest combustion chamber as an input chamber and ending with a smallest combustion chamber as an output chamber; and ejecting hot, combusted exhaust gases which are multiply combusted within said device, whereby pollution of said waste products is controlled, energy is produced, and said variety of waste products are processed.

2. The method of claim 1 further comprising the step of forming a jet thrust with said ejected hot combustion exhaust gases.

3. An apparatus for combusting a variety of combustible waste products including incompletely combusted exhaust gases from other combustion processes and solid combustible waste combined with controlled amounts of water comprising:

injection means for injection said combustible products to form explosive mixtures;

combustion means for multiply combusting said injected combustible products in explosive combustions to produce energy, said combustion means comprising a plurality of serially communicated combustion chambers, said plurality of serially communicated combustion chambers comprising a sequence of combustion chambers of decreasing volume, said volume decreasing from an input chamber, said input chamber being the largest chamber of said plurality of chambers to an output chamber, said output chamber being the smallest chamber of said plurality of chambers, said input chamber being provided with said injected combustible product by said injection means, said remaining ones of said plurality of serially communicated chambers receiving in sequence combustion products from preceding ones of said plurality of chambers, said water when used being hydrolyzed within said combustion means for reducing and oxidizing said combustible products when solid combustible products are used;

ejection means for ejecting said multiply combusted products;

oxidizing injection means for injecting an oxidizing agent into each said chamber; and ignition means communicating with at least said input chamber for initiating and maintaining combustion in said apparatus, whereby said variety of products may be combusted within said apparatus.

4. The apparatus of claim 3 further comprising a controller means for controlling said injection means, combustion means and injection means according to said combustion products supplied thereto and to establish a continuous self-sustaining combustion within said apparatus.

5. The apparatus of claim 3 further comprising secondary process means for utilizing energy produced by said apparatus and said ejected exhaust gases.

* * * * *